US006251007B1

(12) United States Patent
Smith

(10) Patent No.: US 6,251,007 B1
(45) Date of Patent: Jun. 26, 2001

(54) TRANSITION INLET DIFFUSER

(76) Inventor: Randall L. Smith, 1519 Rowewood Dr., Chattanooga, TN (US) 37421

( * ) Notice: Subject to any disclaimer, the term of this patent is extended or adjusted under 35 U.S.C. 154(b) by 0 days.

(21) Appl. No.: 09/498,771

(22) Filed: Feb. 5, 2000

(51) Int. Cl.[7] ..... F24F 13/06
(52) U.S. Cl. ..... 454/292; 454/306; 454/330
(58) Field of Search ..... 454/284, 292, 454/296, 306, 330; 62/DIG. 16

(56) References Cited

U.S. PATENT DOCUMENTS 3,907,050 * 9/1975 Mullings ..... 454/330 X
4,043,777 * 8/1977 Parren ..... 62/DIG. 16
5,054,379 * 10/1991 Sodec ..... 454/284 X

FOREIGN PATENT DOCUMENTS 0 305 335 * 3/1989 (EP) ..... 454/284
0 395 923 * 11/1990 (EP) ..... 454/284

* cited by examiner

*Primary Examiner*—Harold Joyce
(74) *Attorney, Agent, or Firm*—Miller & Martin LLP

(57) ABSTRACT

An air diffuser plenum for use with climate control systems to direct air to desired locations within the interior of a building. An inlet receives air from the climate control system. Within the air diffuser plenum is a cavity which receives the incoming air. The bottom of the housing has a diffuser insert mounted thereon which directs air from the cavity to outlets connected to the sides of the diffuser. The diffuser has a rectangular inlet to cooperate with a transition duct which preferably installed from the roof into a building. The diffuser also has a transition portion directing air from the inlet to a substantially square cross section area prior to directing air out of the vents. A method for making the diffuser is also disclosed.

18 Claims, 14 Drawing Sheets

PRIOR ART

PRIOR ART

PRIOR ART

PRIOR ART

PRIOR ART

PRIOR ART

PRIOR ART

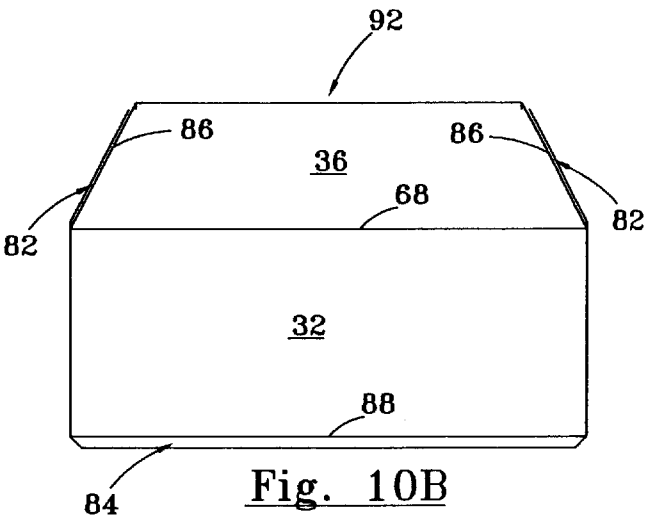
Fig. 10B
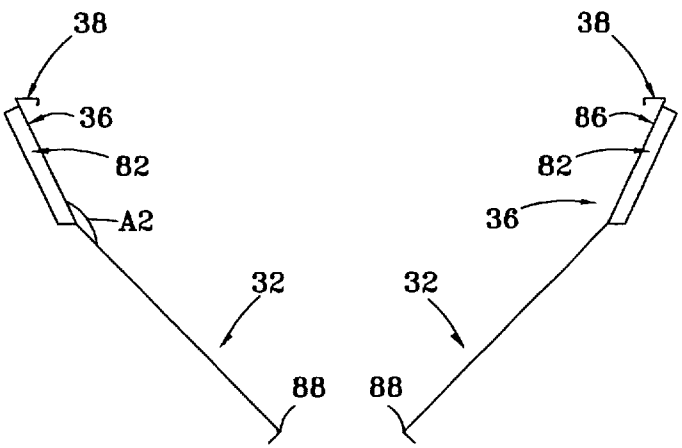
Fig. 10C
Fig. 10D
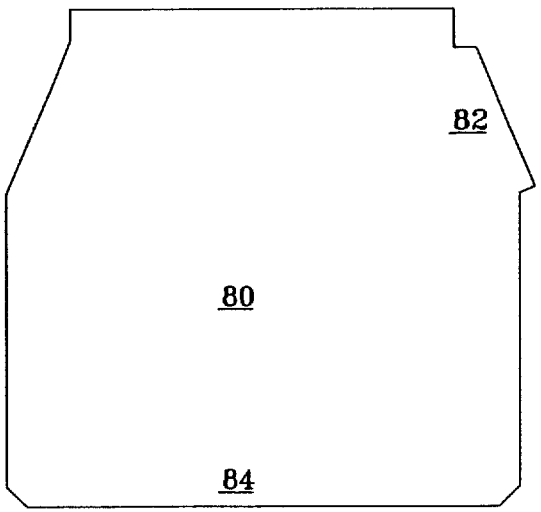
Fig. 10A

TRANSITION INLET DIFFUSER

BACKGROUND OF THE INVENTION

This invention relates to an outlet air diffuser for use with climate control systems such as a roof mounted heating, ventilating and air conditioning systems for supplying air to a space in a building within which the climate is controlled by the system, and more particularly to a multiport outlet diffuser receiving conditioned air from a duct and directing it into the space and a method for manufacturing the diffuser.

Climate control systems used in heating, ventilating and air conditioning systems (HVAC systems) are often utilized in buildings to provide a desired climate within a space in the building. In buildings of a commercial nature, such as warehouse-type retail stores, the climate control units are often mounted on the roof and at least one duct typically extends downwardly from the units through the roof. In these constructions, the duct, or ducts, within the building comprise a plenum which connects the climate control unit to a diffuser. The plenum communicates air between the inlet of the air diffuser and the outlet of the climate control unit. Diffusers often have ports which extend in various directions to efficiently direct the air to various locations within the building in which the diffuser is located. See FIGS. 1 and 3–5 for prior art diffuser designs. FIG. 2 is a prior art diffuser insert.

Some buildings utilize structures, known as roof curbs, which are typically installed with the roof during roof construction. The roof curb may become a permanent part of the roof. Typically, a climate control unit is positioned and/or connected above the curb and connects with the plenum to a diffuser or the climate control unit.

Traditionally, the outlets of the HVAC climate control equipment are rectangular in configuration. It is believed that this rectangular configuration is a result of manufacturers' attempts to provide air flow through a pair of roofjoints. Additionally, the openings within roof curbs which receive the outlet air from an HVAC unit are similarly rectangular in nature, as shown in FIG. 6D. Furthermore, the inlet to prior art diffusers are typically square. Accordingly, the prior art transition ducts, in addition to providing a plenum, also transition from the rectangular outlet of the HVAC unit to the square inlet of the diffuser as illustrated in FIGS. 6A–6C.

Typically, in the prior art a pair of trancissions, or transition ducts, have been provided between the outlet of the roof curb and the inlet of the diffuser plenum. Also in the prior art, the transition duct is typically connected to a roof curb by removing one side of a removable side portion of a roof curb, positioning the transition duct from below, reinstalling the removable side and bolting the transition duct to the roof curb from the top of the roof. Next, the diffuser will be installed to the transition duct, also from below. The prior art construction techniques require the connection at least two different interfaces all from within the building at an elevation above floor level. This process is labor and time intensive.

In the traditional construction technique, the rectangular shape of the opening through the roof curb has a longer length than width. The square sides of the diffuser inlet are longer than the narrow width of the curb opening. Accordingly, the transition duct could not be installed from the top as the cross-sectional area of the portion which mates with the diffuser would not fit through the curb opening if one attempted to position it through the roof on the top. This necessitated the removal of a side of the curb.

At least one manufacturer has developed a plenum of substantially square dimensions and an appropriate roof curb having square dimensions such that the square connecting duct may be installed from the top of the roof directly through the roof curb and bolted into place from the top of the roof as illustrated in FIG. 7. Then, the only connection which needs to be made within the building is connecting the diffuser to the bottom of the connecting duct. In this construction technique, however, it is believed that additional ductwork will be necessary above the roof curb to connect the curb to the outlet of an HVAC unit having a rectangular outlet. Accordingly a need exists to connect a traditional HVAC outlet to the traditional roof curb along with a diffuser where much of the installation may be performed from at or above the roof.

SUMMARY OF THE INVENTION

Accordingly, it is an object of the present invention to provide an air diffuser for use in a climate control system having a climate control unit mounted above a roof communicating through a roof curb and a transition piece to the air diffuser. The transition piece is configured to be installed from above the roof curb through a traditional rectangular roof curb opening. The diffuser need only be installed at one interface to the transition duct.

It is a further object of the present invention to significantly reduce the time required to install climate control systems described herein.

Another object of the invention is to reduce the labor necessary to connect the portions of the systems located below the roof.

Another object of the present invention is to provide a method for constructing the improved air diffuser as taught herein.

Another object of the invention is to provide efficient distribution of air to a desired location.

BRIEF DESCRIPTION OF THE SEVERAL VIEWS OF THE DRAWINGS

The particular features and advantages of the invention as well as other objects will become apparent from the following description taken in connection with the accompanying drawings in which:

FIG. 10A is a plan view of a second side panel B illustrated in FIG. 8A prior to bending for construction of the diffuser.

FIG. 10B is a plan view of the first side panel B illustrated in FIGS. 10A after bending and ready for installation as illustrated in FIG. 8A.

FIG. 10C is a side plan view of the panel of FIG. 10B as viewed from a first end.

FIG. 10D is a second side plan view of the panel of FIG. 10B as viewed from the other end.

DETAILED DESCRIPTION OF THE INVENTION

FIGS. 1–7 are directed to the prior art.

Referring to FIGS. 8A–8E, a diffuser 10 of the presently preferred embodiment is illustrated. This diffuser is a "four-way" diffuser as it is capable of directing air in four separate directions or ways. This device in its preferred mode of operation is connected to at least one duct such as a trancission, or a transition duct 12 (as illustrated in FIGS. 8B–8C, and FIGS. 13A–C). The transition duct 12 communicates through a roof curb (illustrated in FIG. 6D) into a climate control system, such as an HVAC system (not illustrated). Thus, air from an HVAC unit is delivered to the interior of a building through the diffuser 10.

The diffuser 10 could also be connected to other duct designs for use in other climate control systems. For example, although a four-way design is illustrated, a plurality of directional vents could be utilized in similar construction methods and techniques. For example, three-way diffusers, two-way diffusers and six way diffusers could be produced as well. Also, the diffuser improvements as taught in copending application Ser. No. 09/489,402 filed Jan. 21, 2000 by Applicant entitled Air Diffuser Plenum, incorporated herein by reference, could also be incorporated into this construction.

The diffuser is preferably constructed from sheet metal material of a workable thickness as is known in the art. The sections of sheet metal utilized to construct the diffuser 10 may be cut out from a pattern or burned out with a computer controlled plasma cutting table. Intersections of different sections of sheet metal may occur through bending of a piece of sheet metal or through joining two pieces of sheet metal together such as by welding as taught herein.

Figure 8B:
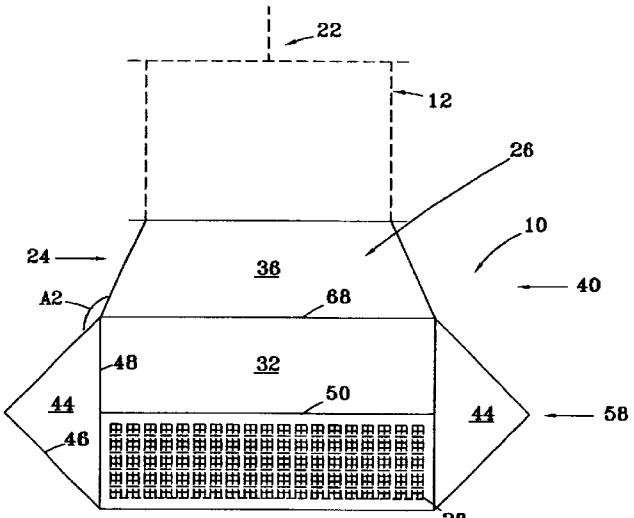
FIG. 8B is a side plan view of the diffuser of FIG. 8A with a transition duct installed on top thereof.
Figure 8C:
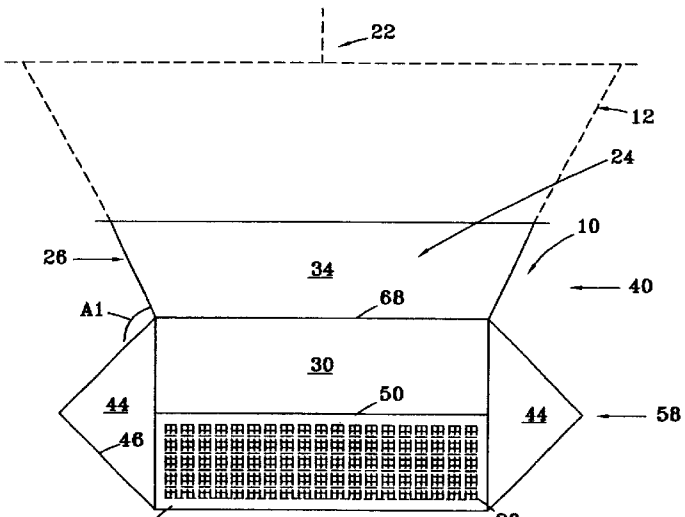
FIG. 8C is a second side plan view of the diffuser of 8A with the diffuser and transition duct turned 90 degrees relative to the view of 8B.
Figure 8A:
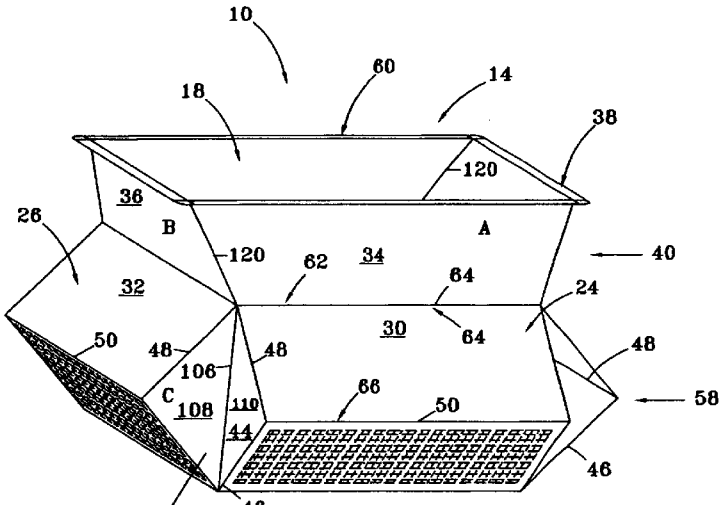
FIG. 8A is a top perspective view of the presently preferred embodiment, illustrating a four-way air diffuser with the vents shown in phantom.

In operation, air is delivered into the diffuser 10 through inlet 14. Some air may enter the inlet 14 along axis 22. The diffuser 10 has a housing 16 having an inlet 14 and a cavity 18 therein. As best seen in FIG. 8A, within the sides 24, 26 of the diffuser 10 is the cavity 18. From the cavity 18, air is expelled out of vents 20 (shown in phantom).

Figure 1A:
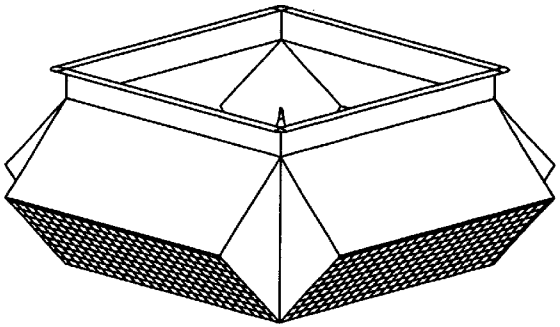
FIG. 1A is a top perspective view of a first prior art diffuser design.
Figure 1D:
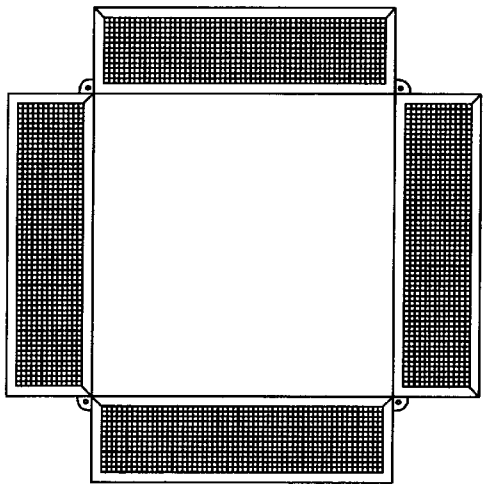
FIG. 1D is a bottom plan view of the diffuser of FIG. 1A.
Figure 1B:
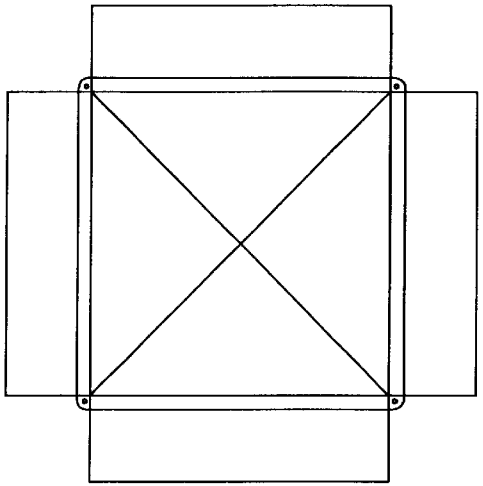
FIG. 1B is a top plan view of the diffuser of FIG. 1A.
Figure 1C:
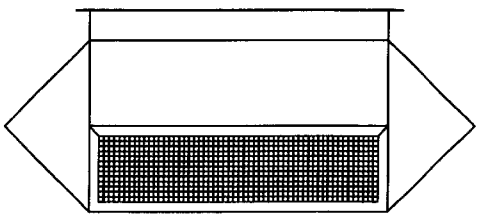
FIG. 1C is a side plan view of the diffuser of FIG. 1A.
Figure 2D:
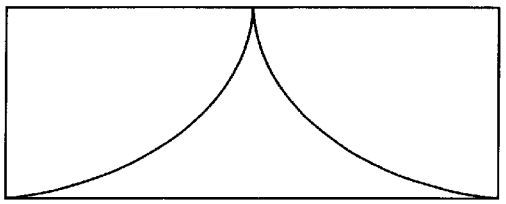
FIG. 2D is a side plan view of the insert of FIG. 2A.
Figure 2E:
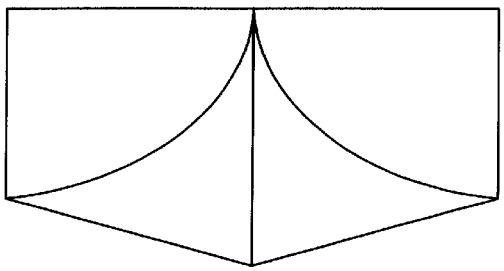
FIG. 2E is a side plan view of the insert of FIG. 2A, with the insert turned 45 degrees relative to the view of 2D.
Figure 2A:
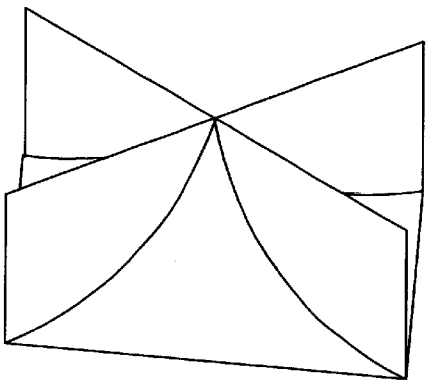
FIG. 2A is a top perspective view of a prior art diffuser insert.
Figure 2C:
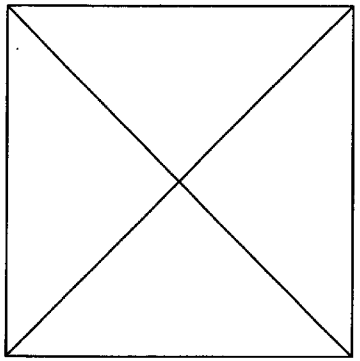
FIG. 2C is a bottom plan view of the insert of FIG. 2A.
Figure 2B:
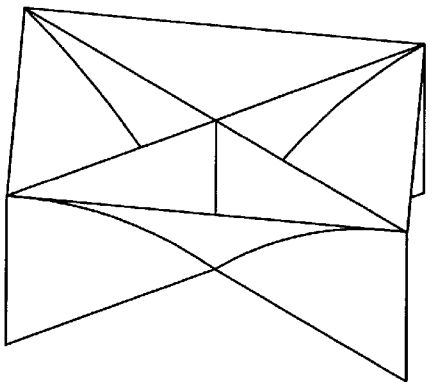
FIG. 2B is a bottom perspective view of the insert of FIG. 2A.
Figure 3A:
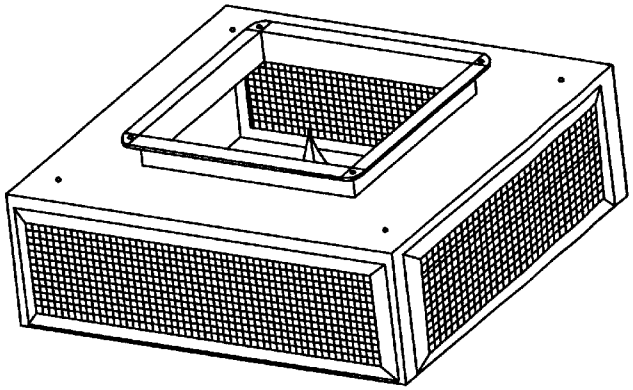
FIG. 3A is a top perspective view of a second prior art diffuser design.
Figure 3D:
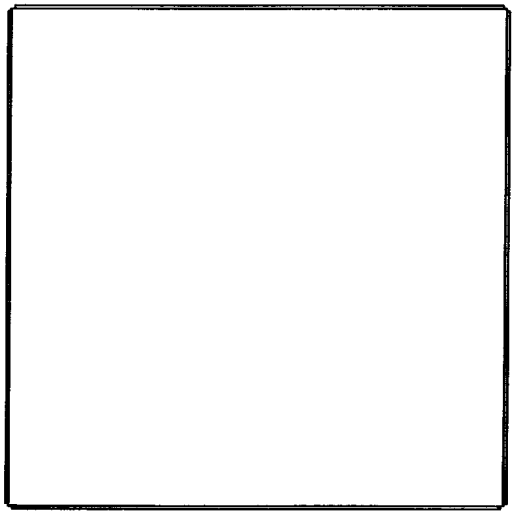
FIG. 3D is a bottom plan view of the diffuser of FIG. 3A.
Figure 3B:
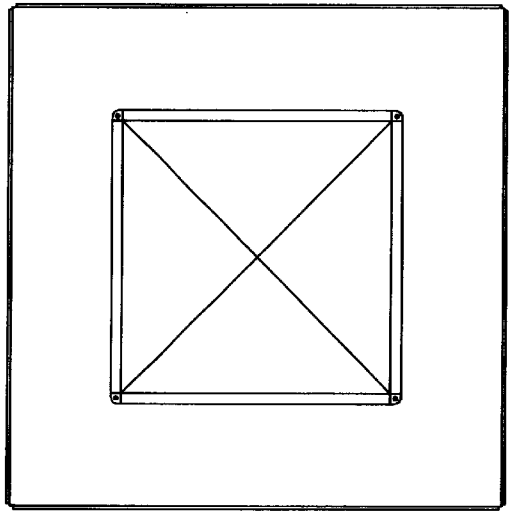
FIG. 3B is a top plan view of the diffuser of FIG. 3A.
Figure 3C:
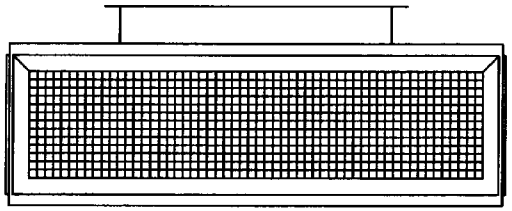
FIG. 3C is a side plan view of the diffuser of FIG. 3A.
Figure 4A:
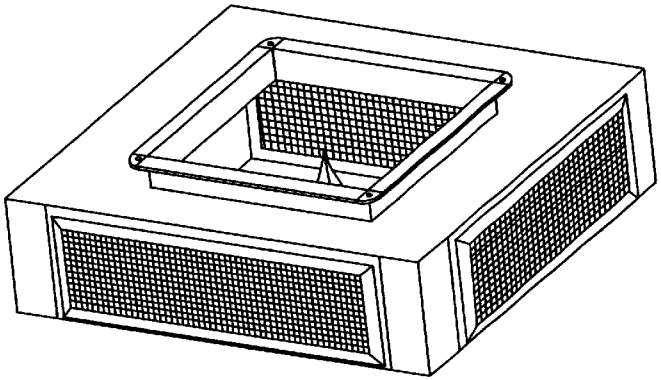
FIG. 4A is a top perspective view of a third prior art diffuser design.
Figure 4B:
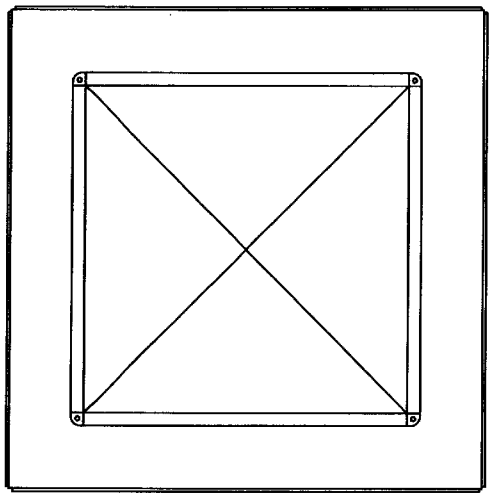
FIG. 4B is a top plan view of the diffuser of FIG. 4A.
Figure 4C:
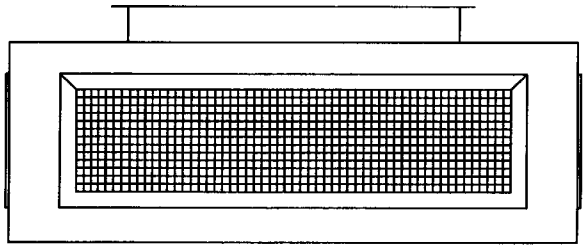
FIG. 4C is a side plan view of the diffuser of FIG. 4A.
Figure 4D:
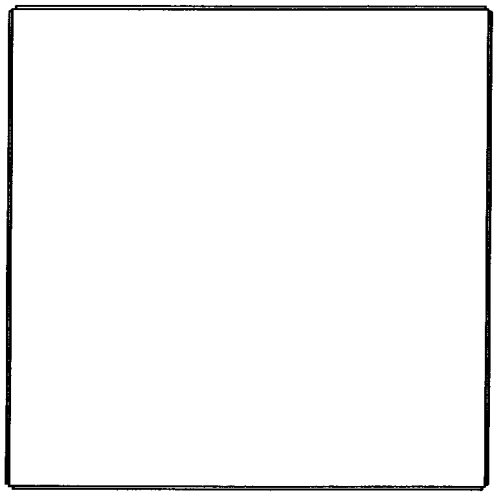
FIG. 4D is a bottom plan view of the diffuser of FIG. 4A.
Figure 5A:
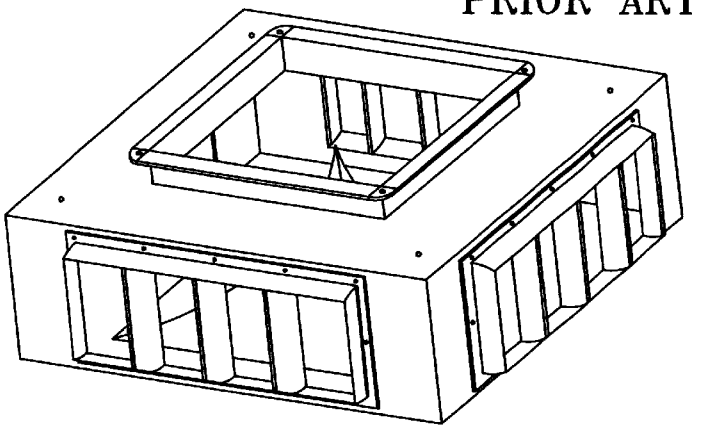
FIG. 5A is a top perspective view of a fourth prior art diffuser design.
Figure 5D:
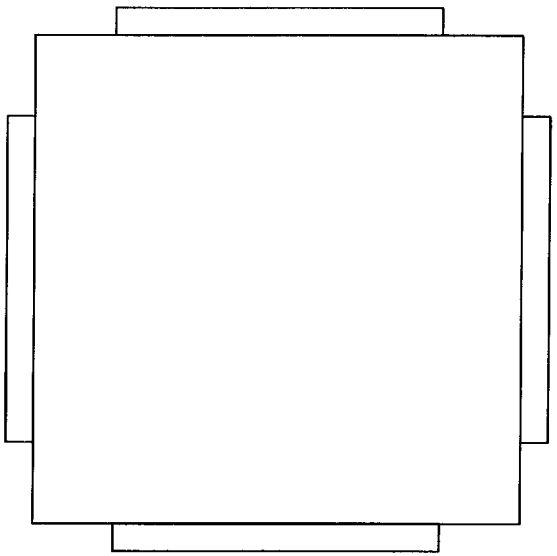
FIG. 5D is a bottom plan view of the diffuser of FIG. 3A.
Figure 5B:
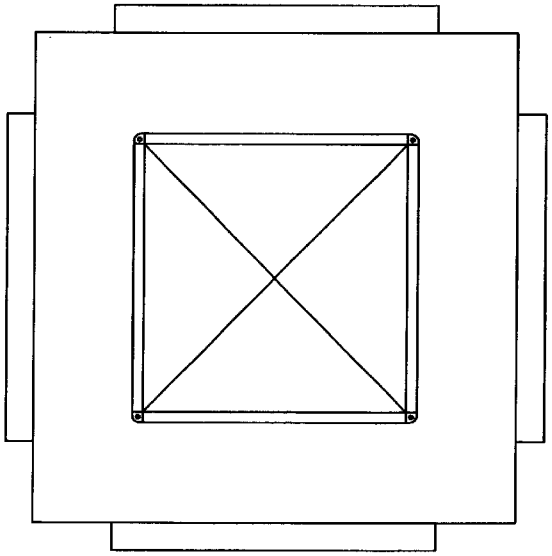
FIG. 5B is a top plan view of the diffuser of FIG. 5A.
Figure 5C:
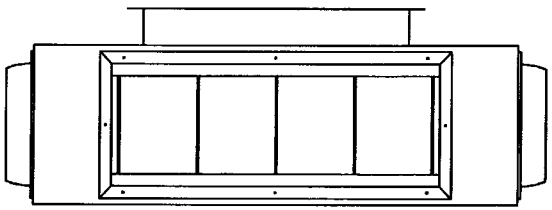
FIG. 5C is a side plan view of the diffuser of FIG. 5A.
Figure 6D:
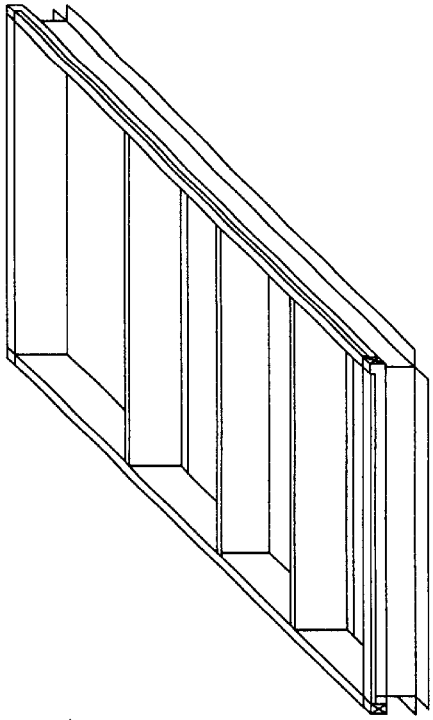
FIG. 6D is a perspective view of a prior art roof curb.
Figure 6C:
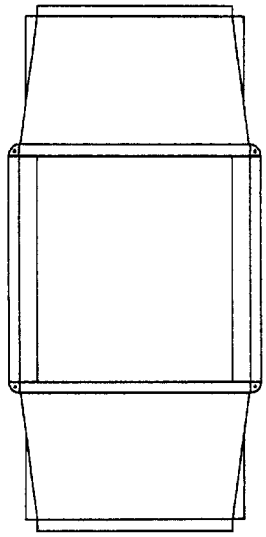
FIG. 6C is a bottom plan view of the transition duct of FIG. 6A.
Figure 6A:
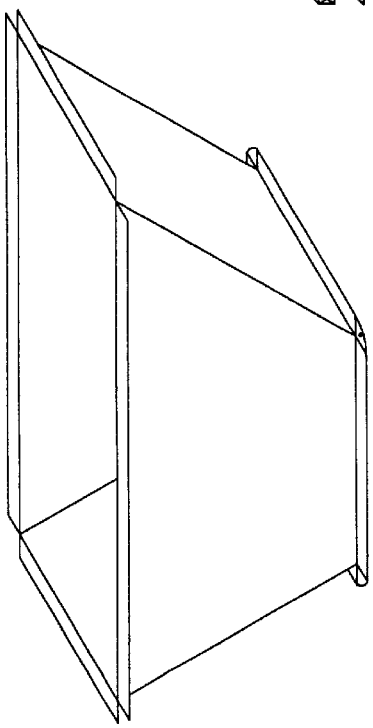
FIG. 6A is a perspective cutaway view of a prior art transition duct.
Figure 6B:
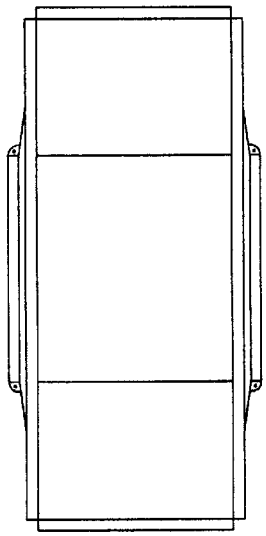
FIG. 6B is a top plan view of the transition duct of FIG. 6A.
Figure 7:
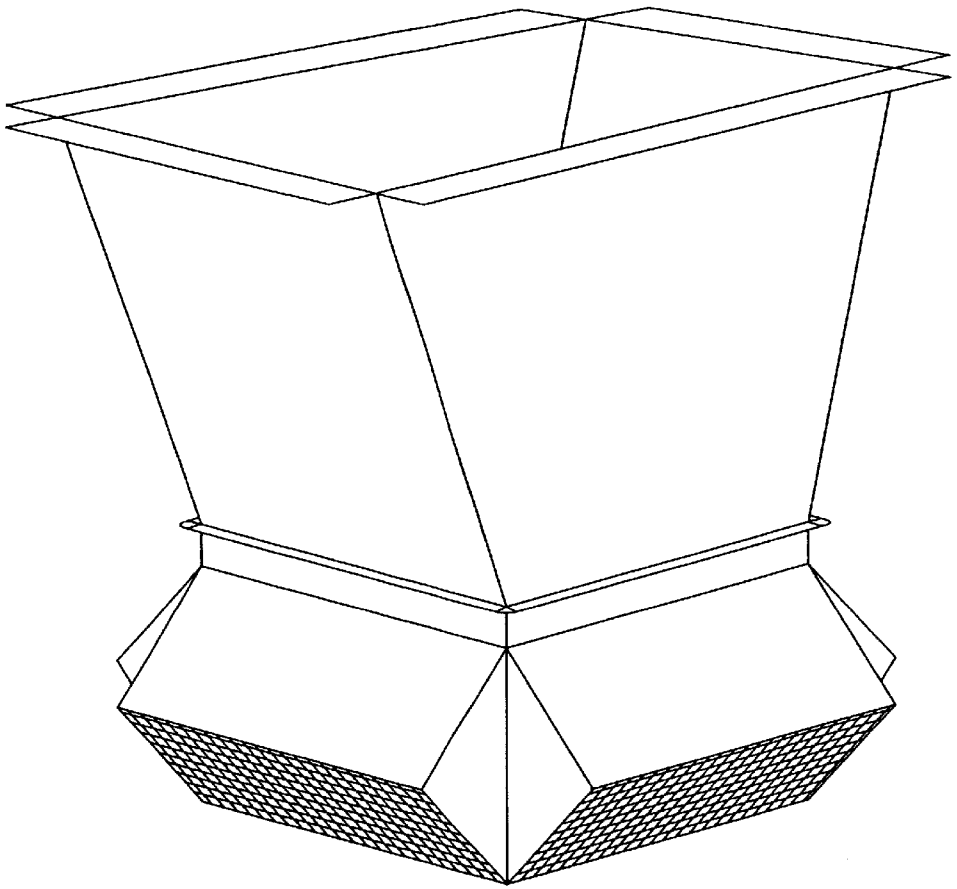
FIG. 7 is a perspective view of a second prior art transition duct connected to a prior art diffuser design.

The vents 20 of the preferred embodiment are illustrated in FIGS. 8A–8C, and 8E; however, a variety of other vent designs could be utilized as well. Some vents have a grid covering as is illustrated in FIGS. 1A, 3A and 4A. Other vent designs are of a more open construction as shown in FIGS. 5A and 5C. Some vents employ multi-directional louvers while others are substantially uni-directional. Furthermore, some vent designs may allow for movement of the vent 20 once installed, or may allow for the installation at a variety of possible angular relationships. The vents 20 illustrated have grill coverings 28 over the vent 20.

The preferred embodiment utilizes two different sides, a first and second side 24, 26. The sides 24, 26 have an upper surface 30, 32 which preferably connects with a transition portion 34, 36, respectively. The transition portions preferably have a flange 38 on one or both of the first and second transition portions 34, 36. The flange 20 may be formed with a transverse duct connection (TDC) machine or through other methods known in the art. The flange 38 is preferably utilized to connect the diffuser 10 to the transition duct (illustrated in FIGS. 8B–C and 13A–C). The transition section 40 which is comprised of the transition portions 34, 36 communicates with a duct as illustrated in FIGS. 8B–C to provide air into the cavity 18.

The sides 24, 26 also preferably have a vent receiver 42 which connects with the upper surfaces 30, 32 respectively.

The vent receiver 42 connects the vent 20 to the rest of the diffuser 10. The vent receiver 42 may allow for off the shelf vents 20 to be utilized. The vent receiver 42 may also be a portion of the vent 20 allowing a vent 20 to be connected directly to at least one of the upper surfaces 30, 32, side surfaces 44, or bottom surfaces 46. The vent receiver 42 is also illustrated connected to side surfaces 44 at side-receiver interface 46. The side surfaces 44 are also shown connected to the upper surfaces 30, 32 at upper interfaces 48. The upper surfaces 30, 32 connect to the vent receivers 42 at upper-receiver interface 50.

Figure 8E:
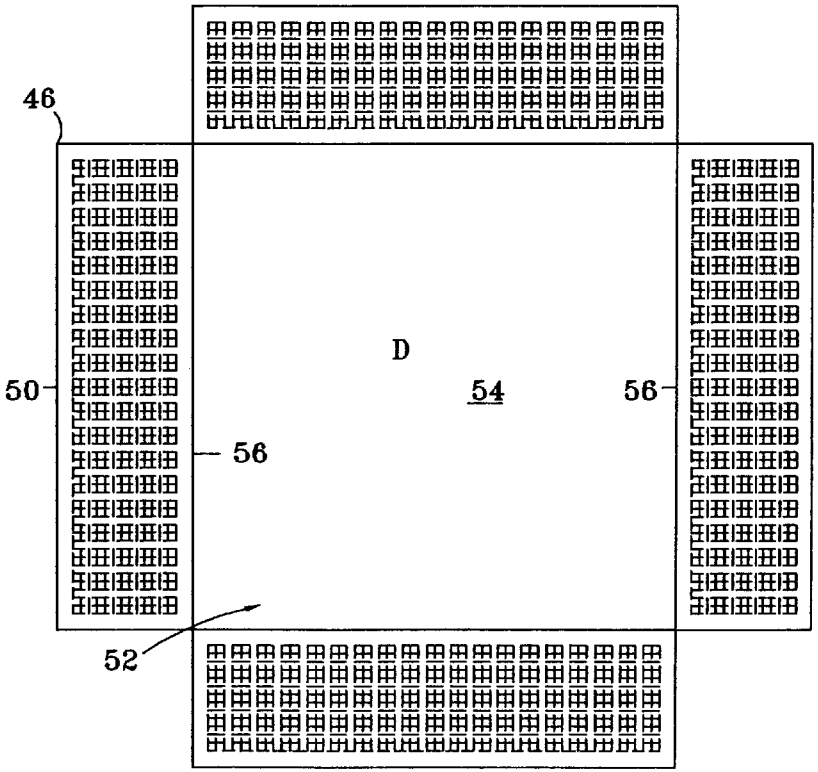
FIG. 8E is a bottom plan view of the diffuser of FIG. 8A.
Figure 8D:
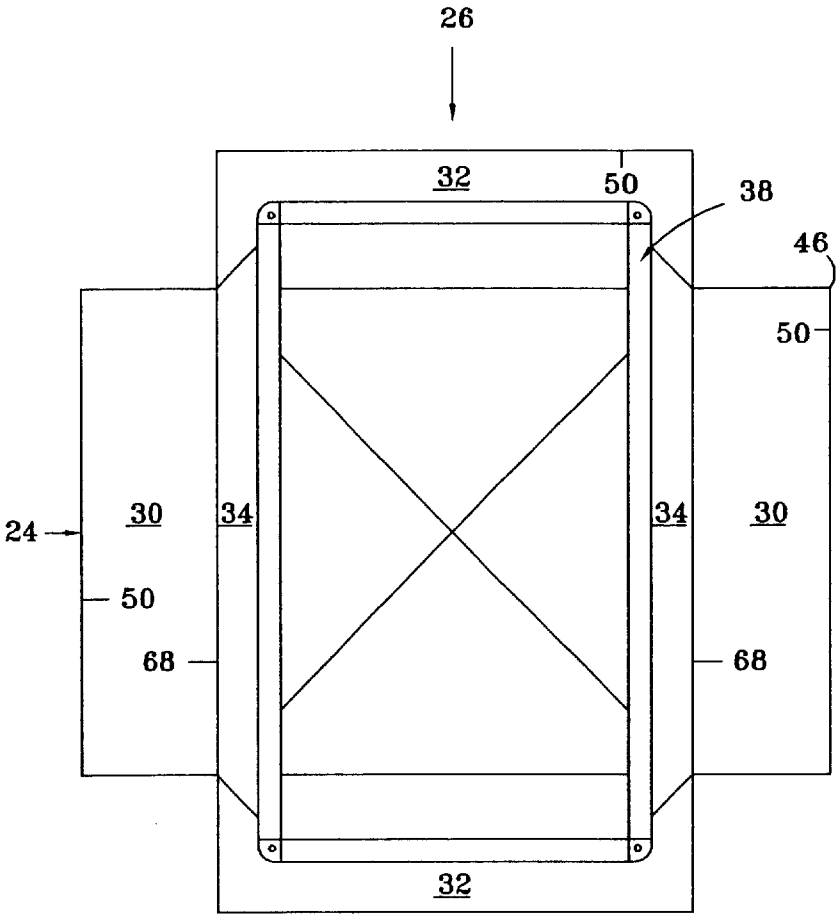
FIG. 8D is a top plan view of the diffuser of FIG. 8A.

FIG. 8E shows the bottom portion 52 of the diffuser 10. The bottom 36 is preferably constructed of a bottom panel 54, however a plurality of bottom panels such as those described in copending application for Air Diffuser Plenum described above, could also be utilized. The bottom panel 54 intersects the vent receivers 42 at bottom-receiver interface 56.

The transition inlet diffuser 10 may be thought of as two sections, the transition section 40 and the diffuser section 58. The transition section 40 preferably connects with the transition duct 12 and the diffuser section 58 preferably directs air to a desired location. The transition section 40 preferably has an inlet rectangular cross sectional area at a top portion 60 which coincides with the outlet rectangular cross section area of the transition duct 12 of FIGS. 13A–C. As air flow continues in the diffuser 10 from the inlet 14 into the cavity 18, the cross sectional area changes from rectangular where the width is less than the length to substantially square in cross section at the bottom portion 62 of the transition section 40. A substantially square cross sectional area would be comprised of an area where the length and width are substantially the same. The transition section 40 and the diffuser section 58 join at the transition-diffuser section interface 68. At this interface 68, the cross sectional areas of the bottom portion 62 of the transition portion 40 and the top portion 64 of the diffuser portion 58 are preferably substantially the same. The top portion 64 of the diffuser portion 58 is preferably formed by the junction of the upper surfaces 32, 34 and, possibly, the side surfaces 44.

In constructing the diffuser 10 of the presently preferred embodiment, with the exception of the vents 20, vent receivers 42, and diffuser insert (see FIGS. 2A–2E), a plurality of at least some of four other parts may be utilized to construct the diffuser 10.

Figure 9B:
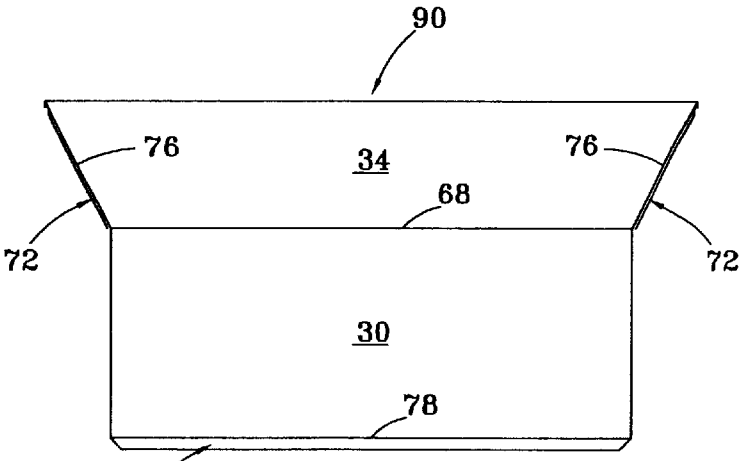
FIG. 9B is a plan view of the first side panel A illustrated in FIGS. 9A after bending and ready for installation as illustrated in FIG. 8A.
Figures 9C, 9D:
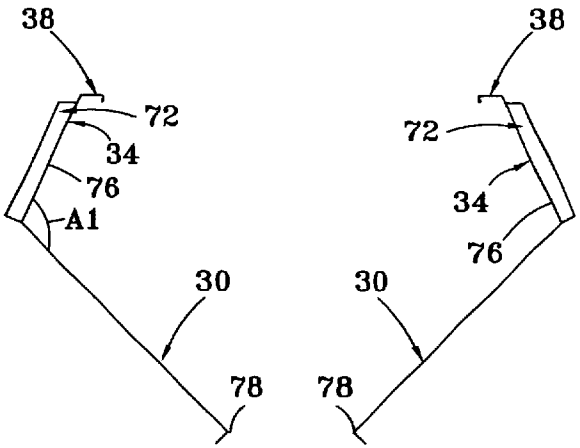
FIG. 9C is a side plan view of the panel of FIG. 9B as viewed from a first end.
FIG. 9D is a second side plan view of the panel of FIG. 9B as viewed from the other end.
Figure 9A:
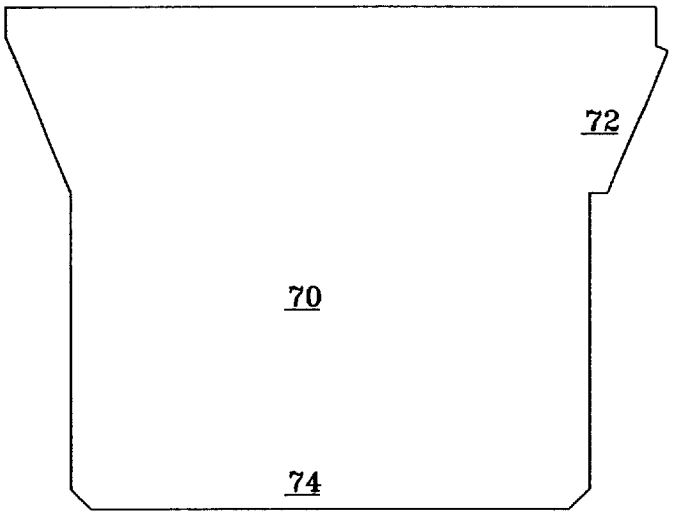
FIG. 9A is a plan view of a first side panel A illustrated in FIG. 8A prior to bending for construction of the diffuser.

FIGS. 9A–9D are representations of panel A before construction of the diffuser 10 illustrated in FIGS. 8A–E. FIG. 9A is a representation of panel A prior to bending of any portions. Panel A is represented as first panel 70. Preferably, first panel 70 is cut from a stock of sheet metal. First tab 72 may be bent to form first tab interface 76. Second tab 72 may be bent to form second tab interface 78. If two first tabs 72 are utilized as shown in FIG. 9B, then two first tab interfaces 76 may be created. Additionally, in some configurations, the use of first or second tabs 72, 74 may not be necessary at all, however the use of first and second tabs 72, 74 has been found helpful in connecting portions of the diffuser 10 together. Additionally, panel A is preferably bent along the transition-diffuser section interface 68 to form first upper section 30 and first transition portion 34. In the preferred embodiment, two panel A's are utilized to form the diffuser 10.

Additionally, two panel B's are utilized to form the diffuser 10. FIGS. 10A–10D illustrate panel B, as second panel 80, in various stages of construction. Preferably, second panel 80 is cut from a stock of sheet metal. First tab 82 may be bent to form first tab interface 86. Second tab 82 may be bent to form second tab interface 88. If two first tabs 82 are utilized as shown in FIG. 10B, then two first tab interfaces 86 may be created. Additionally, in some configurations, the use of first or second tabs 82, 84 may not be necessary at all, however the use of first and second tabs 82, 84 has been found helpful in connecting portions of the diffuser 10 together. Additionally, panel B is preferably bent along the transition-diffuser section interface 68 to form second upper section 32 and second transition portion 36. In the preferred embodiment, two panel B's are utilized to form the diffuser 10.

The principal differences between the first and second panels 70, 80 of the preferred embodiment are the length of the upper portions 82, 84 of the first and second transition portions 34, 36 respectively and the angles A1 and A2 between the transition portions 34, 36 and the upper surfaces 30, 32. Angle A2 is larger than angle A1, and the length of the first upper portion 82 of the first transition portion 34 is greater than the length of the second upper portion 82 of the second transition portion 36.

Figure 11A:
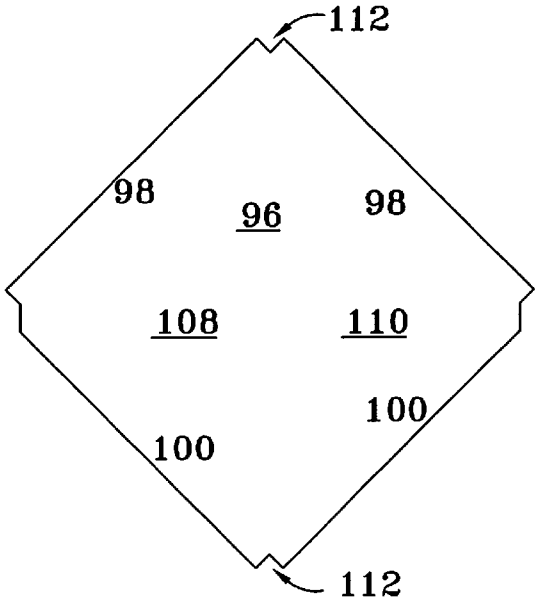
FIG. 11A is a plan view of a third panel C illustrated in FIG. 8A prior to bending for construction of the diffuser.
Figure 11C:
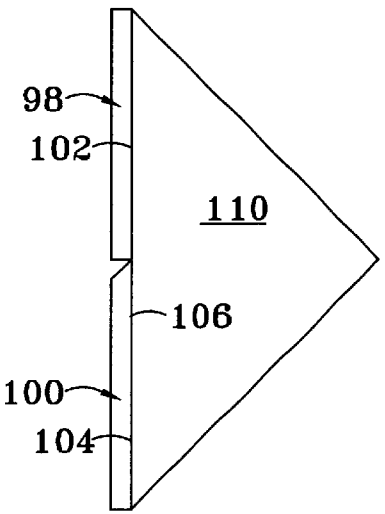
FIG. 11C is a second side plan view of the panel of FIG. 11B as viewed from the other end.
Figure 11B:
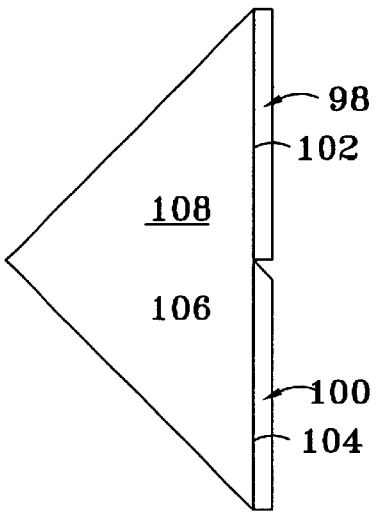
FIG. 11B is a side plan view of the panel of FIG. 11A after bending and ready for installation as as viewed from a first end.

In the preferred embodiment, four panel C's, side surfaces 44, are prepared as illustrated in FIGS. 11A–C. Preferably, side surface panel 96 is cut from a stock of sheet metal. Third tab 98 may be bent to form third tab interface 102. Fourth tab 100 may be bent to form second tab interface 104. If two third tabs 98 are utilized as shown in FIG. 11, then two third tab interfaces 102 may be created. If two fourth tabs 100 are utilized as shown in FIG. 11, then two fourth tab interfaces 104 may be created. Additionally, in some configurations, the use of third or fourth tabs 98, 100 may not be necessary at all, however the use of third and fourth tabs 98, 100 has been found helpful in connecting portions of the diffuser 10 together. Additionally, panel C is preferably bent along the side interface 106 to form first side portion 108 and second side portion 110. The side interface 106 is best illustrated in FIG. 8A and is formed by bending between first end 112 and second end 114 (see FIG. 11A). In the preferred embodiment, four panel C's are utilized to form the diffuser 10.

Figure 12B:
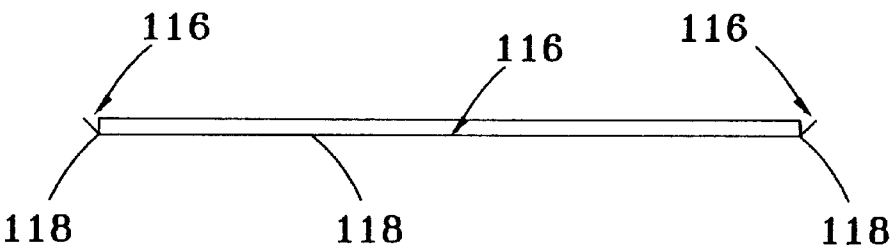
FIG. 12B is a plan view of the first side panel D illustrated in FIGS. 12A after bending and ready for installation as illustrated in FIG. 8A.
Figure 12A:
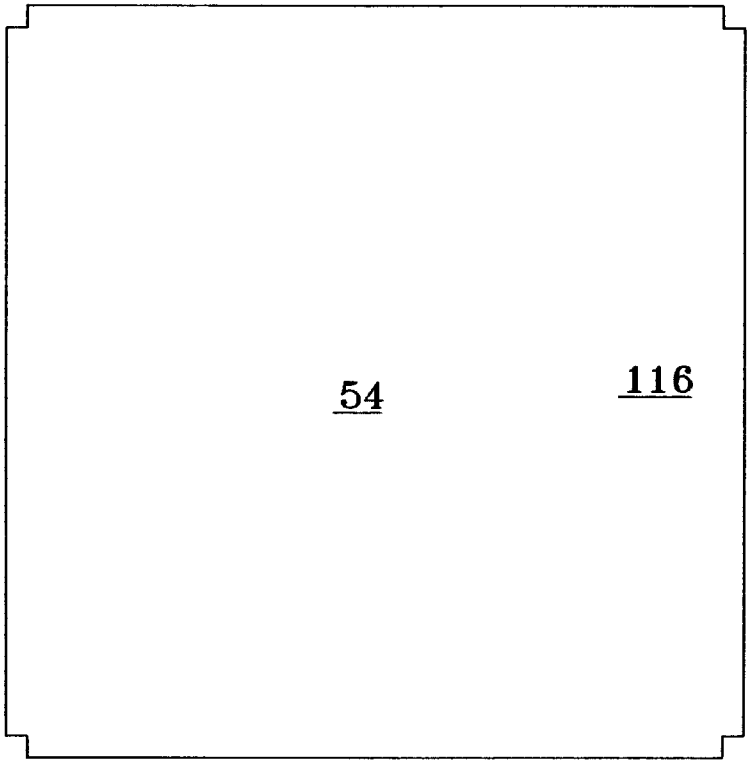
FIG. 12A is a plan view of a fourth panel D illustrated in FIG. 8A prior to bending for construction of the diffuser.

The bottom D, illustrated as bottom panel 54, is preferably prepared as illustrated in FIGS. 12A–B. FIG. 12A illustrates the cutout portion prior to installation. FIG. 12B illustrates fifth tabs 116 bent to form bottom interfaces 118.

Once the parts are formed, they may be connected together. The order of connection is not believed to be particularly important, however it has been found advantageous to connect the bottom panel 54 last so that the diffuser insert of FIG. 2A–E may be installed within the diffuser 10.

The first and second panels 70, 80 may be joined along their first tabs 72, 82. Regardless of whether tabs 72, 82 are utilized, the panels 70, 80 may be joined by welding or other connection means known in the art including riveting, adhesives or other methods. The first and second panels 70, 80 are preferably connected along first tab interface 76 of the first panel 70 and the first tab interface 86 of the second panel 80. The tabs 72, 82 may be connected together. The interfaces 76, 86 may be connected together. Alternatively a combination of the tabs 72, 82 and interfaces 76, 86 may be connected together. The first and second panels are illustrated connected at panel interface 120 in FIG. 8A.

The side panels 44 may be connected to the first and second panels 70, 80 along upper-side interfaces 48. The sides panels may have third tabs 98 bent at third tab interface 102 which may be utilized to assist in the process. Alternatively, the side panel may be connected directly at the third tab interface 102 as well or in addition to connection at the third tab 98. The connection will preferably appear as illustrated in FIG. 8A along upper-side interfaces 48 with the third tab 102 obscured from view, underneath the first and second upper surfaces 30, 32.

The vent receiver 42 may be connected to the upper surfaces (either 30, 32) and side panels 44. When connecting the vent receivers 42 to the upper surfaces 30, 32, the second tabs 74, 84 may be utilized. When connecting the vent receiver to the sides, fourth tabs 100 may be utilized. FIG. 8A shows the vent receiver installed along upper-receiver interface 50 and side-receiver interface 46.

The diffuser insert (FIG. 2A–E) may be inserted within the diffuser 10, and the bottom panel 54 may be connected. The bottom panel 54 may be connected to the vent receivers 42 with fifth tabs 116. The bottom panel 54 may also be connected to the vent receivers 42 along the bottom interfaces 118. FIG. 8E shows the bottom panel 54 installed along the bottom-receiver interfaces 56.

Figure 13A:
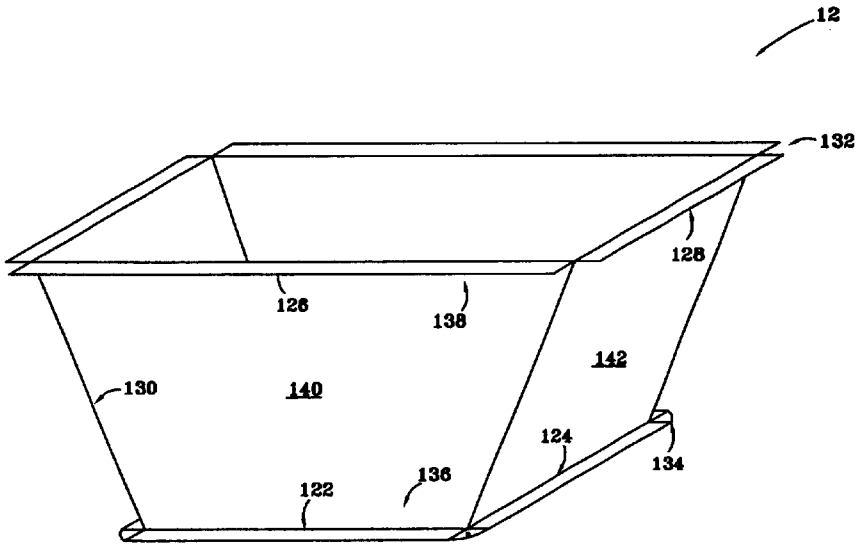
FIG. 13A is a perspective view of the preferred embodiment of a transition duct utilized in conjunction with the diffuser of FIG. 8A.
Figure 13B:
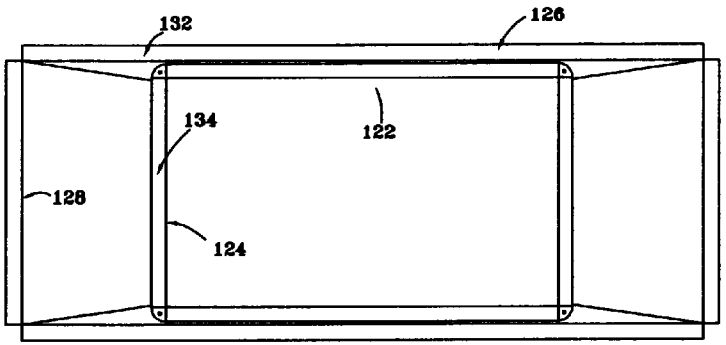
FIG. 13B is a bottom plan view of the transition duct of FIG. 13A.
Figure 13C:
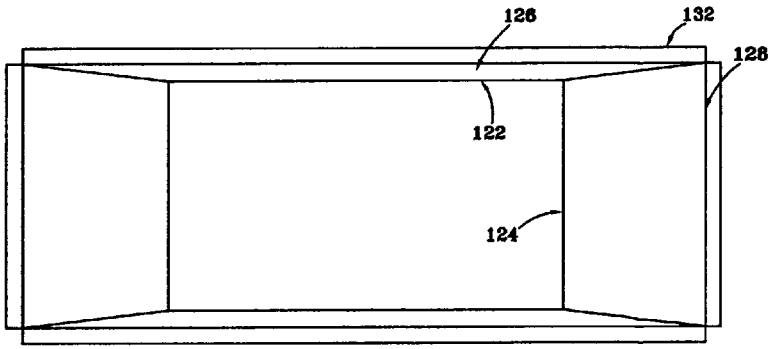
FIG. 13C is a top plan view of the transition duct of FIG. 13. A.

FIG. 13A–C illustrate the preferred transition duct 12 utilized with the diffuser 10. The transition duct 12 has a bottom portion 136 and a top portion 138. The duct 12 is preferably constructed of two sides, first and second sides 140, 142. The first side bottom members 122 and second side bottom members 124 are connected to form a bottom surface area having a first length and a first width in a substantially rectangular shape. The first and second side top members 126, 128 connect at the top portion 138 to form a top cross sectional area having a second length and a second width in a substantially rectangular shape. The bottom cross sectional area is smaller than the top cross sectional area and furthermore, the first width is preferably equal to or less than the second width. Preferably, the first length is also less than the second length. This preferred narrowing down from the top to the bottom portions 136, 138 assists in the ability to install the transition duct 12 from a roof into a building at the roof curb (see FIG. 6D). The first and second sides 140, 142 meet at side connection 132. Top and bottom flanges 134, 136 may also be utilized to assist in the installation of the transition duct 12.

After installing the transition duct 12 into a roof curb (FIG. 6D), the diffuser 10 may be connected to the duct 12. Additionally, a HVAC unit may be installed above the roof curb to direct air through the plenum and into the diffuser 10.

While preferred embodiments of the invention have been described above, it is to be understood that any and all equivalent realizations of the present invention are included within the scope and spirit thereof. Numerous alterations of the embodiments herein disclosed will suggest themselves to those skilled in the art. However, it is to be understood that the present disclosure relates to the preferred embodiments of the invention which is for purposes of illustration only and not to be construed as a limitation of the invention. All such modifications which do not depart from the spirit of the invention are intended to be included within the scope of the appended claims.

I claim:

1. An air diffuser comprising:

a housing having a cavity therein, at least two sides, a bottom portion and an inlet;

said inlet adapted to interface with a transition duct having a substantially rectangular outlet cross sectional area, said inlet of the housing located above at least a portion of the cavity and the bottom portion;

a plurality of vents located on said at least two sides of the housing;

the inlet of the housing having a substantially rectangular cross sectional area defined by a first length and a first width, said housing having an intermediate portion with a substantially square cross sectional area defined by a second length and a second width, wherein said first length is greater than said first width and said second length is substantially equal to said second width;

an axis at the inlet, and a transition portion between the inlet and the intermediate portion, said transition portion defined by two pair of opposing sides angled relative to said axis respective sides of one of said pair of opposing sides acutely angled relative to said axis and respective sides of the other pair of opposing sides obtusely angled relative to said axis.

2. The air diffuser of claim 1 in combination with a transition duct, said transition duct comprising a duct inlet having a substantially rectangular cross sectional area defined by a duct inlet length and a duct inlet width and a duct outlet having a substantially rectangular cross sectional area defined by a duct outlet length and a duct outlet width; wherein at least one of said duct inlet length and duct inlet width is greater than at least one of said duct outlet length and duct outlet width.

3. The air diffuser of claim 1 wherein said first length is greater than said second length.

4. The air diffuser of claim 1 further comprising a transition section and a diffuser section joined at the intermediate section, said diffuser section having a plurality of upper surfaces connected to vents, said transition section defined by two pair of opposing sides, wherein at least one of said opposing sides is integrally formed with at least one of said upper surfaces.

5. The air diffuser of claim 4 wherein said at least one of said opposing sides is integrally formed respectively with a corresponding upper section.

6. An air diffuser for use in a climate control system providing air to a desired space formed by the process comprising the steps of:

a. preparing at least two first side panels in a first pattern, each of said at least two first side panels having at least one side-to-side interface, a top portion of a first length, an intermediate portion of a second length, and a bottom portion of a third length, said side-to-side interface extending from the top portion to the intermediate portion;

b. preparing at least two second side panels in a second pattern, each of said at least two second side panels having at least one side-to-side interface, a top portion of a fourth length, an intermediate portion of a fifth length, and a bottom portion of a sixth length, said side-to-side interface extending from the top portion to the intermediate portion, wherein the first length of the first panel is greater than the fourth length of the second panel, and the second length of the first panel and the fifth length of the second panel are substantially equal;

c. connecting the at least two first and second side panels along at least a portion of said side-to-side interfaces to form a portion of the housing;

d. locating vents on the housing; and e. completing the housing to provide air communication from the inlet through the vents.

7. The air diffuser of claim 6 wherein the third and sixth lengths are substantially equal.

8. The air diffuser of claim 6 wherein said side-to-side interfaces of at least one of the first and second side panels extends from the top portion to the intermediate portion.

9. The air diffuser of claim 6 wherein at least one of the first and second side panels further comprise first tabs extending from said side-to-side interface, wherein said first tabs assist in the connection of adjacent first and second side panels.

10. The air diffuser of claim 6 wherein the locating of vents on the housing further comprises at least temporarily connecting said vents to said housing at an interface.

11. The air diffuser of claim 6 wherein the step of completing the housing further comprises connecting at least one third side panel to at least one of the first panels, second panels, and vents to provide air communication from the inlet through the vents.

12. The air diffuser of claim 11 wherein the step of completing the housing further comprises connecting at least one bottom panel to at least one of the first side panels, second side panels, third side panels, and vents to provide air communication from the inlet through the vents.

13. The air diffuser of claim 6 wherein the step of preparing the at least two first side panels requires the first side panels to be bent along the second length of the intermediate portion.

14. The air diffuser of claim 6 wherein the step of preparing the at least two second side panels requires the second side panels to be bent along the fifth length of the intermediate portion.

15. A method of making an air diffuser having a transition inlet in a housing comprising the steps of:

a. preparing at least two first side panels in a first pattern, each of said at least two first side panels having at least one side-to-side interface, a top portion of a first length, an intermediate portion of a second length, and a bottom portion of a third length, said side-to-side interface extending from the top portion to the intermediate portion;

b. preparing at least two second side panels in a second pattern, each of said at least two second side panels having at least one side-to-side interface, a top portion of a fourth length, an intermediate portion of a fifth length, and a bottom portion of a sixth length, said side-to-side interface extending from the top portion to the intermediate portion, wherein the first length of the first panel is greater than the fourth length of the second panel, and the second length of the first panel and the fifth length of the second panel are substantially equal;

c. connecting the at least two first and second side panels along said side-to-side interfaces to form a portion of the housing;

d. locating vents on the housing; and e. completing the housing to provide air communication from the inlet through the vents.

16. The method of claim 15 wherein the preparation of said at least two first side panels comprises cutting the at least two first side panels from a blank of sheet metal.

17. The air diffuser of claim 15 wherein at least one of the first and second side panels further comprise first tabs extending from said side-to-side interface, wherein said first tabs assist in the connection of adjacent first and second side panels.

18. The air diffuser of claim 15 wherein the step of preparing the at least two first side panels requires the first side panels to be bent along the second length of the intermediate portion.

* * * * *